United States Patent [19]

Eury

[11] Patent Number: 4,581,861

[45] Date of Patent: Apr. 15, 1986

[54] BAFFLE BOARD CONSTRUCTION

[76] Inventor: Matthew D. Eury, 163 Poplar Tent Rd., Concord, N.C. 28025

[21] Appl. No.: 604,903

[22] Filed: Apr. 27, 1984

[51] Int. Cl.[4] ..... E04B 7/00

[52] U.S. Cl. ..... 52/95; 52/199

[58] Field of Search ..... 52/94, 95, 198, 199

[56] References Cited

U.S. PATENT DOCUMENTS

| | | | |
|---|---|---|---|
| 3,160,987 | 12/1964 | Pinkley | 52/95 |
| 3,683,785 | 8/1972 | Grange | 52/95 X |
| 4,069,628 | 1/1978 | Kreimer | 52/94 |
| 4,185,433 | 1/1980 | Cantrell | 52/404 |
| 4,214,510 | 7/1980 | Ward | 52/95 X |
| 4,265,060 | 5/1981 | Woodhams | 52/92 |
| 4,269,007 | 5/1981 | Ward | 52/92 |

*Primary Examiner*—Carl D. Friedman

*Attorney, Agent, or Firm*—W. Thad Adams, III

[57] ABSTRACT

A baffle board (10) is disclosed for being mounted between the roof and ceiling of a room to provide ventilation along the underside of the roof and to prevent insulation between the ceiling and roof from being disturbed by air currents. Baffle (10) includes a sheet of stiff, relatively thin material (11) having outwardly and longitudinally extending side tabs (12, 13) defined by respective, perforated lines (12*a*, 13*a*). Side tabs (12, 13) are adapted to be folded at substantially right angles to the sheet and fastened to the inner facing surfaces of adjacent roof rafters. Sheet (11) also defines on one end thereof an end tab (14) defined by score lines (14*a*, 14*b*, 14*c*). End tab (14) is adapted to be folded back under sheet (11) and fastened to the top plate of the exterior wall.

3 Claims, 10 Drawing Figures

FIG. 1
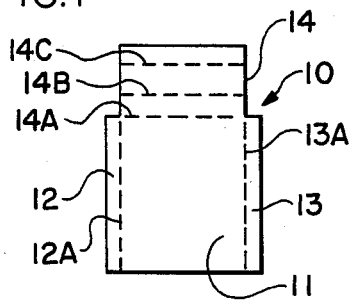
FIG. 3
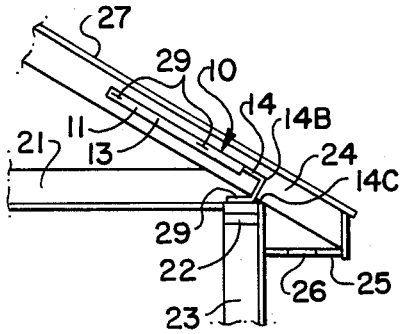
FIG. 2
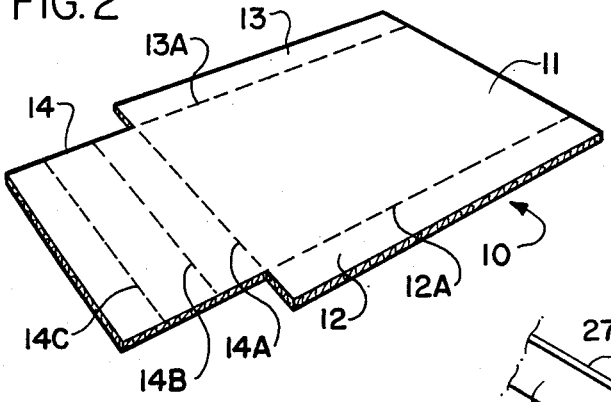
FIG. 4
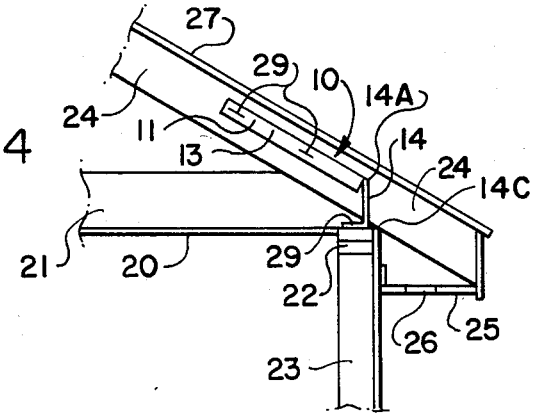
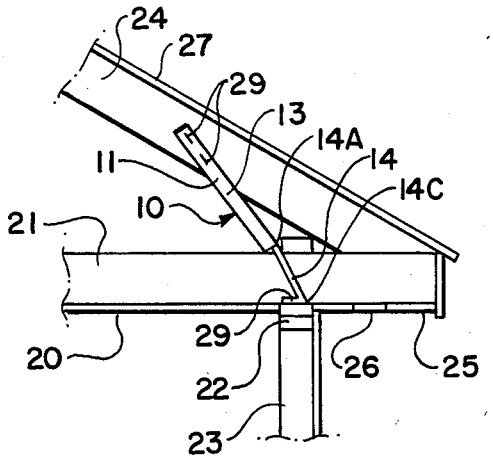
FIG. 5

BAFFLE BOARD CONSTRUCTION

TECHNICAL FIELD AND BACKGROUND OF THE INVENTION

This invention relates to a baffle board especially designed for use in housing construction of the type wherein a space is defined between an inclined roof and a horizontal building. The baffle board permits ventilation under the underside of the roof and, at the same time, prevents insulation from being disturbed by air currents which may pass through ventilation spaces and then into the space between the roof and the ceiling. In construction of the type where the baffle board is commonly used, the ceiling is formed by plurality of spaced-apart horizontal ceiling joists mounted on the top plate of a stud wall. The roof is formed of a plurality of covered, spaced-apart roof rafters which are inclined and intersect the ceiling joists approximate to the stud wall.

There are many types of known baffle boards. However, most such constructions are so complicated as to be difficult to install by a single worker. The most common baffle board which is presently available for sale is disclosed in the Cantrell U.S. Pat. No. 4,185,433. In the construction shown in Cantrell, a baffle board is formed by intersecting parallel rows of perforated lines and parallel, opposed sets of slits (see FIGS. 3 and 9). In order to properly install the Cantrell baffle board, all of the tabs which are defined by the perforated lines and the slits, must be folded down and simultaneously maintained in proper position during installation. Furthermore, the lower-most tab is designed to abut the top plate at the point where the metal plates on the truss rafters are positioned. This causes a considerable amount of difficulty in installation and consequently, requires a substantial length of time to install.

Use of a baffle board is now particularly important because of the use of a truss roof and continuous air vents which extend the length of the roof under the eaves. These air vents are necessary to prevent excess temperatures from building up under the roof. However, they also permit extremely strong air currents to flow through the space between the roof and the ceiling. During a strong wind, granular insulation can be blown as far back as about 18 inches from where the edge of the ceiling and the stud walls intersect. Permitting this to happen causes discoloring on the underside of the ceiling along the outer walls which necessitates painting and repairs. It also substantially reduces the R factor of the insulation at the edge of the ceiling since much, if not all of it, is blown away.

Therefore, it is an object of the present invention to provide a baffle board which prevents granular insulation from being blown back from the outside edge of the ceiling by air currents through vents.

It is another object of the present invention to provide a baffle board which permits suitable ventilation of the space between the ceiling and the roof while leaving the insulation therein undisturbed.

SUMMARY OF THE INVENTION

These and other objects and advantages of the present invention are achieved in the preferred embodiment disclosed below by providing a baffle board for being mounted over an exterior wall and between the roof and a ceiling of a building. The ceiling is formed by a plurality of spaced-apart ceiling joists mounted on the top plate of stud walls and the roof is formed of a plurality of covered, spaced-apart roof rafters intersecting the ceiling joists proximate the stud walls. The baffle board comprises a sheet of stiff, relatively thin material which has an outwardly and longitudinally extending side tab integrally formed on opposite sides of the sheet. The side tabs are defined by respective, perforated lines and are adapted to be folded at substantially right angles to the sheet and fastened, preferably by staples, to adjacent roof rafters with the sheet supported there between. The sheet also defines on one end thereof an end tab having a width substantially equal to the width of the sheet with the side tabs folded at right angles thereto. The end tab is defined only by a score line and not by slits between the end tab and the side tabs. The end tab is adapted to be folded back under the sheet and fastened to the top plate. Preferably, the end tab includes three parallel, spaced-apart score lines for permitting the length of the end tab which is folded and fastened to the top plate to be adjusted as is necessary to accommodate the depth of the ceiling joists and the position of the stud wall relative to the intersection of the ceiling joists and roof rafters.

BRIEF DESCRIPTION OF THE DRAWINGS

Some of the objects of the invention have been set forth above. Other objects and advantages of the invention will appear as the description of the invention proceeds, when taken in conjunction with the following drawings, in which:

FIG. 1 is a plan view of a baffle board according to the present invention;

FIG. 2 is a perspective view of the baffle board shown in FIG. 1;

FIG. 3 is a vertical, cross-sectional view of a standard truss roof with the invention thereon;

FIG. 4 is a vertical, cross-sectional view of a truss roof having roof rafters and ceiling joists of a different width, with the invention thereon;

FIG. 5 is a vertical, cross-sectional view of the invention in place on a stick-built roof;

DESCRIPTION OF THE PREFERRED EMBODIMENT

Figure 6:
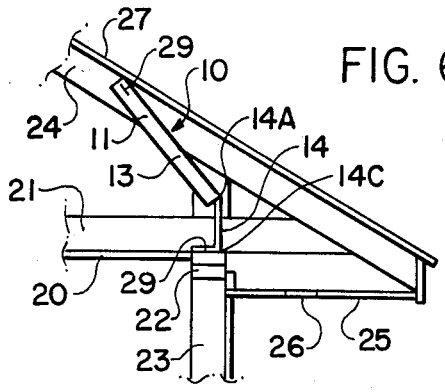
FIG. 6 is a vertical cross-sectional view of the invention in position on an extended overhang-type roof.

Referring now specifically to the drawings, a baffle board according to the present invention is illustrated in FIGS. 1 and 2, and is generally designated at board reference number 10. Baffle board 10 is comprised of a sheet 11 of stiff, relatively thin material such as corrugated cardboard. The cardboard is lightweight, inexpensive and yet reasonably durable so long as it is not exposed directly to moisture.

Sheet 11 has a pair of side tabs 12 and 13 integrally formed on its opposite sides. Side tabs 12 and 13 are defined by perforated lines 12*a* and 13*a*, respectively, to facilitate folding them up into a substantially right angle position to sheet 11. Sheet 11 also has on one of its ends an end tab 14. On the embodiment shown in FIGS. 1 and 2, the end tab is defined by a score line 14*a* and, also, a pair of intermediate score lines 14*b* and 14*c* which permit adjustment of the length of the end tab in relation to the amount folded under sheet 11. This feature will be explained in more detail below.

As used herein, "score line" means a fold line formed by creasing, perforating or cutting partially but not all the way through sheet 11. By "perforation" is meant a score line formed by a line of closely spaced-apart holes.

Referring now to FIG. 3, a standard truss roof construction is shown which includes a ceiling 20 secured to the underside of 2×4 ceiling joists 21 (one shown). The ceiling joists are secured to a top plate 22 which in turn is secured to a top of a stud wall 23. A plurality of spaced-apart, inclined 2×4 roof rafters 24 (one shown) are secured to the ceiling joists 21 and extend outwardly beyond the stud wall 23 to form an overhang. The overhang is boxed in to form eaves 25 having a vent 26 on the underside thereof. The roof rafters 24 are covered with sheathing material 27.

Baffle board 10 is secured between each pair of roof rafters 24 by first turning up side tabs 12 and 13 until they are at substantial right angles to sheet 11. Then, in FIG. 3, a baffle board is positioned in longitudinally extending alignment with roof rafters 24 and secured to the opposing inner sides of adjacent roof rafters 24 by staples 29. End tab 14 is folded back under sheet 11 and is stapled to the top surface of top plate 22.

Figure 7:
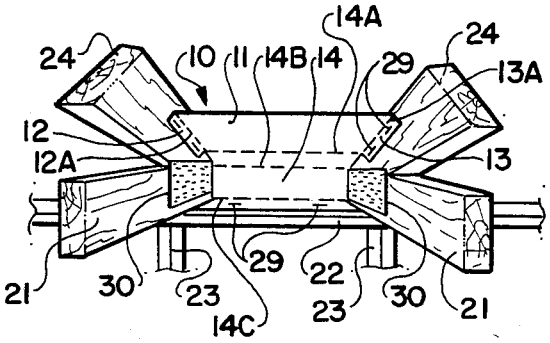
FIG. 7 is a perspective view looking outwardly toward the eaves of the roof with the invention in place on the truss roof shown in FIG. 3.

Therefore, the opening between roof rafters 24 and ceiling joists 21 is partially closed. However, an air space is left along the upper surface of each roof rafter 24 to permit indirect flow of air into the space between ceiling joists 21 and roof rafters 24. This permits proper ventilation through vents 26. This same construction is shown from another view in FIG. 7. Metal joist plates 30 are shown which in some constructions can be used to assist in securing roof rafters 24 and ceiling joists 21 together. The presence of metal joist plates 30 illustrates that the baffle board 10 according to this invention can be properly applied between rafters 24 and staples properly applied therein without interference from the metal joist plates 30.

In FIG. 4 a construction similar to that in FIG. 3 is shown. Therefore, the same reference numerals have been applied to the various components. This has also been done in reference to FIGS. 5 and 6 which show further variations in structure with, however, the same basic components.

In FIG. 4 the spacing shown is that on a roof construction having roof rafters 24 and ceiling joists 21 constructed of 2×6's. As is shown in FIG. 4, baffle board 10 is spaced further away from top plate 22. Therfore, the end tab 14 is bent only on score lines 14*a* and 14*c*.

FIG. 5 illustrates a stick-built type roof. The roof rafters 24 and ceiling joists 21 intersect on the outer side of stud walls 23. Therefore, at the position at where the baffle board 10 must be attached, roof rafters 24 and ceiling joists 21 are further apart than in the constructions shown in FIGS. 3 and 4. For this reason, baffle board 10 is not positioned in alignment with roof rafters 24 but rather extends at an acute angle to roof rafters 24 into contact with top plate 22 so that end tab 14 can be bent under and stapled thereto.

In FIG. 6 yet another construction is shown. This is an extended overhang-type roof with another variation of the manner in which baffle board 10 is secured to the roof rafters 24 and to top plate 22. Note in FIGS. 3, 4, 5 and 6 that an air space is left between baffle board 10 and the underside of sheathing 27 that air can flow in an indirect manner into the space between the ceiling and the roof.

Figure 8:
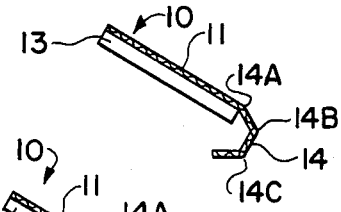
FIG. 8 shows the position of the baffle board in an intermediate position.
Figure 9:
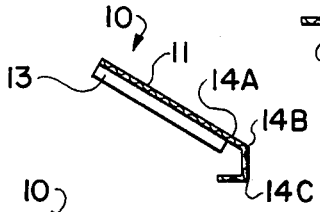
FIG. 9 shows a baffle board with the end tab folded in FIG. 3.
Figure 10:
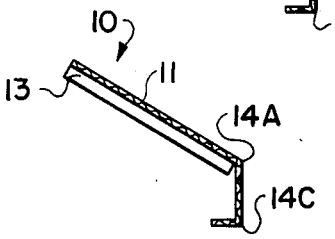
FIG. 10 illustrates the position of the baffle board shown in FIG. 4.

FIGS. 8, 9 and 10 illustrate only three of numerous ways in which the end tab 14 can be bent along score lines 14*a*, 14*b* and/or 14*c* to accommodate different types of roofs and different-sized roof rafters and ceiling joists.

The simplicity of the invention should be emphasized. As a practical matter, the tight spaces within which baffle boards must be installed make it essential that they be easily and quickly installed by one person. Therefore, the baffle board must be simply enough constructed so that it can be easily maneuvered into position and held in position with one hand while it is stapled into position with another. The invention described above achieves these results in a simple and unique construction not disclosed by the prior art. While the discussion above has specifically been related to the use of the baffle board 10 in attics filled with granular insulation, it is also entirely suitable for use in attics with fiberglas batt-type insulation. While corrugated cardboard is an ideal construction material, other materials are also suitable. In addition, in moist environments plastic baffle boards or plastic film-coated cardboard would be a suitable alternative to the construction described above.

A baffle board according to a particular construction is described above. Various details of the invention may be changed without departing the scope of the invention. Furthermore, the foregoing description of the preferred embodiment is for the purpose of illustration only and not for the purpose of limitation—the invention being defined by the claims.

I claim:

1. In a roof and ceiling construction of a building wherein the ceiling is formed by a plurality of spaced-apart ceiling joists mounted on the top plate of stud walls and the roof is formed of a plurality of covered, inclined; spaced-apart roof rafters intersecting the ceiling joists proximate to the stud wall, the combination therewith of a baffle board for mounting over an exterior wall between the roof and ceiling of a building to provide ventilation along the underside of the roof and to prevent insulation between the ceiling and roof from being disturbed by air currents, said baffle board comprising:

(a) a sheet of stiff, relatively thin material having an outwardly and longitudinally extending side tab integrally formed on opposite sides thereof and defined by respective, perforated lines in said sheet, whereby said side tabs adapted are folded at substantially right angles to said sheet and fastened to the interfacing surfaces of adjacent roof rafters;

(b) said sheet also defining on one end thereof an end tab having a width substantially equal to the width of the sheet with side tabs folded at right angles thereto, said end tab defined by a score line and not by slits between said end tab and said side tab, whereby said end tab is folded back under said sheet and fastened to the top plate.

2. A baffle board according to claim 1 wherein the end tab includes three parallel, spaced-apart score lines for permitting the length of the end tab which is folded and fastened to the top plate to be adjusted for length as necessary to accommodate the depth of the ceiling joists and the position of the stud wall relative to the intersection of the ceiling joists and roof rafters.

3. A baffle board according to claim 1 wherein said sheet of stiff, relatively thin material is comprised of corrugated cardboard.

* * * * *